United States Patent [19]

Best

[11] Patent Number: 5,010,755

[45] Date of Patent: Apr. 30, 1991

[54] LOCK WITH TORQUE-RELEASE MEANS

[75] Inventor: Walter E. Best, Indianapolis, Ind.

[73] Assignee: Best Lock Corporation, Indianapolis, Ind.

[21] Appl. No.: 439,238

[22] Filed: Nov. 20, 1989

[51] Int. Cl.[5] ..... E05B 15/16

[52] U.S. Cl. ..... 70/422; 70/222

[58] Field of Search ..... 70/422, 221–224; 292/347, 348, 352, 353, 358

[56] References Cited

U.S. PATENT DOCUMENTS

| | | | |
|---|---|---|---|
| 1,516,152 | 11/1924 | Dumont | 70/422 |
| 3,566,633 | 3/1971 | Borck | 70/422 X |
| 4,195,502 | 4/1980 | Best et al. | 70/224 |
| 4,394,821 | 7/1983 | Best et al. | 70/422 |
| 4,550,581 | 11/1985 | Best et al. | 70/422 |
| 4,655,059 | 4/1987 | Best et al. | 70/224 |
| 4,671,089 | 6/1987 | Fleming et al. | 70/422 X |
| 4,679,420 | 7/1987 | Yang | 70/422 |
| 4,773,240 | 9/1988 | Foshee | 70/222 |

FOREIGN PATENT DOCUMENTS

| | | | |
|---|---|---|---|
| 151081 | 8/1985 | European Pat. Off. | 70/222 |
| 629854 | 9/1949 | United Kingdom | 70/222 |

*Primary Examiner*—Robert L. Wolfe
*Assistant Examiner*—Suzanne L. Dino
*Attorney, Agent, or Firm*—Barnes & Thornburg

[57] ABSTRACT

A torque-releasable door handle assembly is provided for operating a door-latching system. The door handle assembly includes a handle shell formed to include a hollow interior cavity having front and rear openings in the handle shell, a lock cylinder mounted in the hollow interior cavity to position its keyway opening in the front opening of the handle shell, and a torque-release mechanism interconnecting the handle shell and the lock cylinder. The lock cylinder is formed to include an axially extending, radially outwardly opening groove located in the hollow interior cavity. The torque-releasable mechanism normally extends into the groove to establish a driving connection between the handle shell and the lock cylinder. The torque-release mechanism is configured to disengage the groove temporarily to break the driving connection in response to the application of at least a predetermined amount of torque to a lever handle appended to the handle shell. The torque-release mechanism is resettable after each disengaging activity to re-establish the driving connection.

3 Claims, 1 Drawing Sheet

LOCK WITH TORQUE-RELEASE MEANS

BACKGROUND AND SUMMARY OF THE INVENTION

This invention relates to door lock assemblies designed to withstand the application of excessive torque. More particularly, the invention relates to door lock assemblies including a latching system specially coupled to a door handle such as a lever handle or the like so that the door handle disconnects from the latching system under application of excessive torque, thereby preserving the integrity of the latching system.

The invention is of particular utility for door lock assemblies having lever handles, since lever handles are particularly susceptible to the manual application of excessive torque—for example, through use of a pry bar or other tool, or even through the direct wrenching force from the hand of a strong person. Such lever handles are used with increasing frequency today—indeed, may be mandatory in certain settings—because they can easily be operated by handicapped persons or others unable to grip and turn a more conventional knob.

The prior art recognizes the need for a torque-release feature in door lock assemblies. For example, Foshee U.S. Pat. No. 4,773,240 relates to a torque-releasable latching system comprising a body assembly yieldably interconnected to a handle shell via a drive assembly. The drive assembly includes a pair of mateable female and male drive rings. Under application of excessive torque, the male drive ring reciprocates to an inactive position, out of torque-transmitting engagement with the female drive ring. Yang U.S. Pat. No. 4,679,420 also describes a force immune door latch. The door latch in Yang is provided with a resiliently-biased ratcheting means having a biasing force oriented in a direction perpendicular to the longitudinal axis of the door latch shaft. Best, et al U.S. Pat. No. 4,550,581 provides another example. There, application of excessive torque causes the shearing of drive lugs in a frangible drive, thus disengaging the lock assembly from the handle shell. Of course, such a frangible drive is not resettable once the shearing has occurred.

It is thus an object of the present invention to provide a torque-releasable assembly that is resettable after the application of excessive door lock torque has caused disengagement of the handle shell.

A further object of this invention is to provide a torque-releasable door lock assembly with a simple release mechanism that is constructed and assembled easily.

Another object of this invention is to provide a torque-releasable assembly that will maintain a normal driving connection door lock between the handle shell and the body assembly under an applied torque of up to approximately 250–300 in-lb's as applied to the handle shell, but will disengage the body assembly from the handle shell for torques greater than about 300 in-lb's applied to the handle shell.

According to the present invention, a torque-releasable door handle assembly is provided for operating a door latching system. The door handle assembly includes a handle shell preferably including a radially-extending front face and a radially-extending back face situated to lie in spaced apart relation to the front face. Extending between the front and back faces is an axially-extending side wall. The front face, side wall, and back face cooperate to define a hollow interior cavity within the handle shell.

The door handle assembly also preferably includes a rotatable body having a forward portion and a rearward portion. The forward portion extends into the hollow interior cavity of the handle shell to define a detent chamber therein. Importantly, the forward portion has an exterior surface facing the handle shell and is formed to include a radially outwardly opening groove. The rearward portion lies outside of the hollow interior cavity and is mountable in the door to permit rotation of the body with respect to the door.

Drive means is provided for yieldably interconnecting the forward portion of the body and the handle shell to establish a normal driving connection between the forward portion of the body and the handle shell, such connection enabling the forward portion of the body to be rotated about an axis of rotation in response to a torque applied to the handle shell. The drive means is configured to engage the groove to establish the normal driving connection. The drive means is also designed to disengage the groove in response to the application of at least a predetermined amount of torque to the handle shell. Such a disengagement from the groove breaks the normal driving connection. Thus, this feature of the invention serves to minimize the possibility that the integrity of the door latching system will be breached.

In a preferred embodiment, the handle shell includes a lever handle. The drive means is positioned on the opposite side of the axis of rotation from the lever handle. The drive means includes a detent bar and at least one Bellville washer for yieldably biasing the detent bar into the groove. A support block slidably received in the handle shell is provided to support the at least one Bellville washer. The detent bar is slidably received in a channel formed on the support block. Advantageously, retainer means is provided for retaining both the drive means and the forward portion of the body within the handle shell. Thus, the drive means and the forward portion of the body are located forward of the retainer means with respect to the handle shell, providing easy assembly.

The various features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
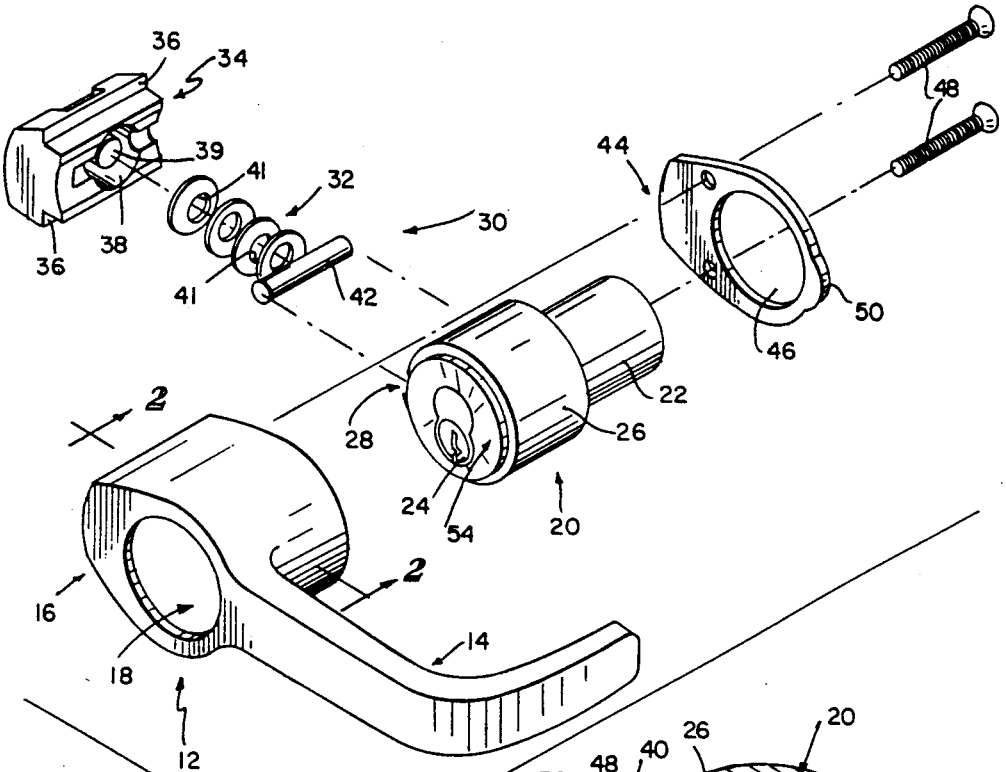
FIG. 1 is an exploded assembly view of an embodiment of the torque-releasable door handle assembly.
Figure 2:
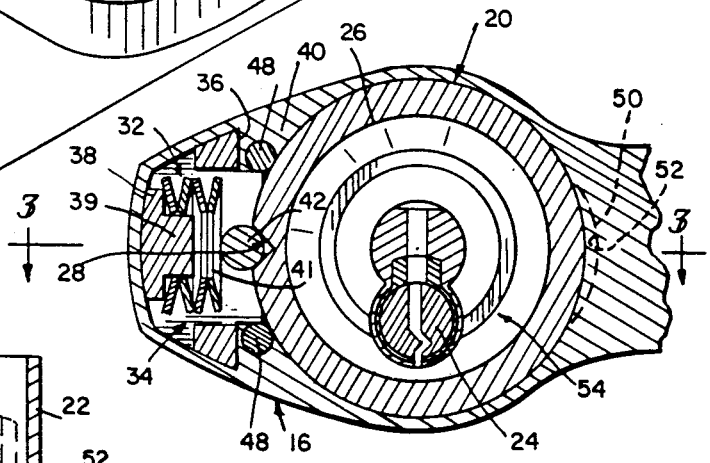
FIG. 2 is a vertical cross-sectional view taken along line 2—2 of FIG. 1 showing a drive assembly and cylindrical sleeve.
Figure 3:
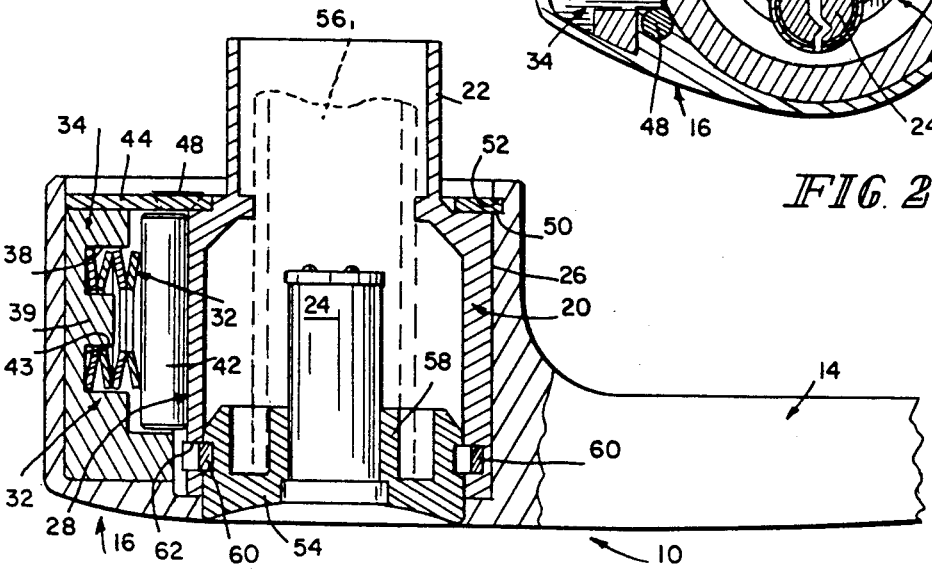
FIG. 3 is a fragmentary top view taken along line 3—3 of FIG. 2.

A preferred embodiment of the torque-releasable door handle assembly in accordance with the present invention is illustrated in FIGS. 1–3. The door lock assembly 10 is shown to include a handle shell 12. As shown best in FIG. 1, handle shell 12 includes a handle lever 14 and a handle body 16. Handle shell 12 is formed to include a core housing 18. Core housing 18 is sized appropriately to receive in slidable engagement a cylindrical sleeve 20.

Cylindrical sleeve 20 includes a hub 22 which is coupled to a door latching assembly (not shown). Sleeve 20 is configured to receive lock core 24. Sleeve 20 has an exterior surface 26 that is formed to include a longitudinally extending, detent-receiving groove 28.

A drive assembly 30 serves to yieldably interconnect handle shell 12 and cylindrical sleeve 20 so that cylindrical sleeve 20 will normally rotate in response to rotation of handle shell 12 about its axis of rotation. Drive assembly 30 includes a washer support block 34, a plurality of Bellville washers 32, and a roller bar detent 42. The roller bar detent 42 is sized to be thrust into the detent-receiving groove 28 by the spring bias of the Bellville washers 32. The Bellville washers 32 and the roller bar detent 42 cooperate to define a detent assembly for holding the cylindrical sleeve 20 in a predetermined driving position in relation to the handle shell 12 to establish a driving connection therebetween. The detent assembly is operable to release the handle shell 12 from engagement with the cylindrical shell 20 upon application of excessive torque to the handle lever 14.

Washer support block 34 includes a pair of grooves 36 configured to accept flanges 40 formed in handle shell 12 to allow washer support block 34 to be slidably received in handle shell 12 as shown in FIG. 2. Block 34 is also formed to include a circular depression 38 designed to support and hold in place Bellville washers 32. An upstanding post 39 is appended to a bottom wall 43 of depression 38. Each Bellville washer 32 is formed to include a central aperture 41 sized to receive the post 39 therein upon placement of the Bellville washers 32 in the depression 38 formed in the washer support block 34.

Bellville washers 32 act against the bottom wall 43 of the depression 38 to bias the roller bar detent 42 into engagement with detent-receiving groove 28. At this point of engagement, a normal driving connection between handle shell 12 and cylindrical sleeve 20 is established. However, in response to the application of at least a predetermined amount of torque to handle lever 14, roller bar detent 42 is moved by handle shell 12 against the bias of Bellville washers 32 to disengage from groove 28, thereby interrupting the normal driving connection between handle shell 12 and cylindrical sleeve 20. In this configuration, torque applied to handle shell 12 will not be transmitted to cylindrical sleeve 20. Thus, the security of the door latching system may be maintained.

Following such an interruption to the normal driving connection, the driving connection between the handle shell 12 and cylindrical sleeve 20 can be reestablished easily without disassembly of the door handle. Handle shell 12 can be rotated relative to sleeve 20 back to a position where detent bar 42 once again is biased by Bellville washers 32 to engage groove 28. Upon engagement, the normal driving connection is reestablished and once again rotation of handle shell 12 about its longitudinal axis will cause the sleeve 20 to rotate and operate the attached door latching assembly (not shown).

Advantageously, drive assembly 30 and cylindrical sleeve 20 are retained within handle shell 12 by rear closure plate 44, providing easy assembly. Plate 44 is provided with opening 46 through which hub 22 extends to engage the door latching assembly (not shown). Plate 44 is secured by screws 48 and by the interconnection of lip 50 with groove 52. Lock core 24 is supported in core housing 18 by face closure member 54 which is provided with rearward extending circular flanges 58. Face closure member 54 is in turn supported for rotation within cylindrical sleeve 20. A ring 60 lies partially in the annular peripheral groove 62 to lock face closure member 54 in axially fixed rotatable relation in cylindrical assembly 20. Additionally, knob sleeve 56 engages circular flanges 58 and is supported for rotation within cylindrical sleeve 20.

Although the invention has been described in detail with reference to the illustrated preferred embodiment, variations and modifications exist within the scope and spirit of the invention as defined in the following claims.

What is claimed is:

1. A door handle assembly for operating a door-latching system, the door handle assembly comprising a lock-receiving cylinder for coupling to the door-latching system, the lock-receiving cylinder being formed to include an axially extending groove, a handle shell surrounding the lock-receiving cylinder, the handle shell including a lever handle and being formed to include an axially extending elongated chamber, drive means for yieldably interconnecting the lock-receiving cylinder and the handle shell to establish a normal driving connection so that the lock-receiving cylinder is rotated about an axis of rotation in response to a first torque level applied to the handle shell and is stationary in response to torque levels above the first torque level, the drive means including a rod sized for mounting in the axially extending groove to establish the normal driving connection and spring means for yieldably biasing the rod toward the axially extending groove, a support block supporting the spring means, the support block being slidably mounted in the elongated chamber and a retainer for retaining the support block and the drive means within the elongated chamber.

2. The door handle assembly of claim 1, wherein the elongated chamber is positioned on the opposite side of the axis of rotation from the lever handle.

3. The door handle assembly of claim 1, wherein the spring means includes at least one Bellville washer.

* * * * *